US012117271B1

(12) United States Patent
Silver

(10) Patent No.: US 12,117,271 B1
(45) Date of Patent: Oct. 15, 2024

(54) HYPERSONIC MISSILE DEFENSE SYSTEM

(71) Applicant: Government of the United States, as represented by the Secretary of the Air Force, Wright-Patterson AFB, OH (US)

(72) Inventor: Arthur Silver, Newport News, VA (US)

(73) Assignee: United States of America as represented by the Secretary of the Air Force, Wright-Patterson AFB, OH (US)

( * ) Notice: Subject to any disclaimer, the term of this patent is extended or adjusted under 35 U.S.C. 154(b) by 90 days.

(21) Appl. No.: 18/180,905

(22) Filed: Mar. 9, 2023

Related U.S. Application Data

(60) Provisional application No. 63/322,681, filed on Mar. 23, 2022.

(51) Int. Cl.
*F41H 11/02* (2006.01)

(52) U.S. Cl.
CPC ..... *F41H 11/02* (2013.01)

(58) Field of Classification Search
CPC ..... F41H 11/02
USPC ..... 102/211
See application file for complete search history.

(56) References Cited

U.S. PATENT DOCUMENTS

| | | | | |
|---|---|---|---|---|
| 6,231,002 | B1 * | 5/2001 | Hibma | F42B 4/20 244/3.22 |
| H002236 | H * | 4/2010 | Nechitailo | F41H 11/02 102/494 |
| 10,703,451 | B1 * | 7/2020 | Adams | F41F 3/10 |

* cited by examiner

*Primary Examiner* — Samir Abdosh
(74) *Attorney, Agent, or Firm* — AFMCLO/JAZ; Richard M. Mescher

(57) ABSTRACT

A hypersonic missile defense system for protecting a target from a hypersonic weapon, wherein the system includes a plurality of globule spheres in a defensive formation between the target and the hypersonic weapon. The globule sphere may include a proximity fuse; a plurality of fission spheres; a capacitor capsule; and a membrane separating a first formation material from a second formation material, both contained within the globule sphere.

9 Claims, 6 Drawing Sheets

HYPERSONIC MISSILE DEFENSE SYSTEM

Pursuant to 37 C.F.R. § 1.78(a)(4), this application claims the benefit of and priority to prior filed Provisional Application Ser. No. 63/322,681, filed 2022 Mar. 22 which is expressly incorporated herein by reference in its entirety.

RIGHTS OF THE GOVERNMENT

The invention described herein may be manufactured and used by or for the Government of the United States for all governmental purposes without the payment of any royalty.

FIELD OF THE INVENTION

The present invention relates generally to hypersonic missile defense systems.

BACKGROUND OF THE INVENTION

Disclosed herein is an improvement in hypersonic missile defense systems. The defense system will utilize stationary or moving defensive fields placed in the path of an incoming missile.

SUMMARY OF THE INVENTION

The present invention overcomes the foregoing problems and other shortcomings, drawbacks, and challenges of missile defense systems. While the invention will be described in connection with certain embodiments, it will be understood that the invention is not limited to these embodiments. To the contrary, this invention includes all alternatives, modifications, and equivalents as may be included within the spirit and scope of the present invention.

The present invention includes a hypersonic missile defense system (HMDS) hypersonic for protecting a target from a hypersonic weapon, wherein the system may include a plurality of globule spheres in a defensive formation between the target and the hypersonic weapon. The globule spheres may include a proximity fuse; a plurality of fission spheres; a capacitor capsule; a membrane separating a first formation material from a second formation material. All in at least one embodiment, within the globule sphere. In one embodiment the fission spheres may include tungsten, depleted uranium, steel or combinations thereof. In one embodiment the fission spheres comprise spherical tungsten coated with hardened steel. The capacitor capsule includes a charged and sealed ceramic. The membrane may in one embodiment comprise a metal such as a corrosion resistant, high nickel alloy. In one embodiment the membrane may be about 3 mm to about 5 mm in thickness.

The invention may further include a process for using the hypersonic missile defense system wherein the globule spheres are launched and placed in the path of the hypersonic weapon and create a defensive formation of globule spheres. In one embodiment the globule spheres detect their proximity to the hypersonic weapon with the proximity fuse and detonate, creating a field of globules that degrade the hypersonic weapon aerodynamics and impede its arrival at the target.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

Figure 1:
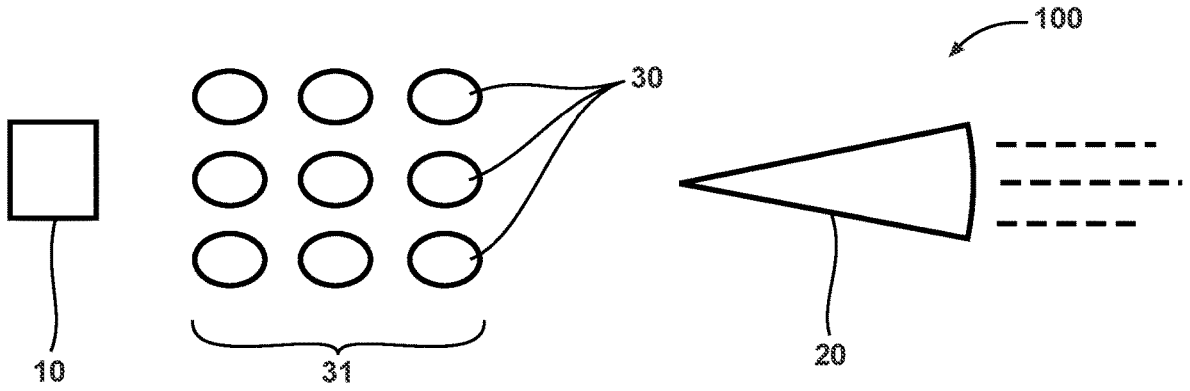
FIG. 1 is a macro-illustration of one embodiment of the present invention.

The present invention is illustrated in FIG. 1 (not to scale) where a hypersonic missile defense system 100 protects a target 10 from a hypersonic weapon 20, wherein the system includes a plurality of globule spheres 30 in a defensive formation 31 between the target 10 and the hypersonic weapon 20. The hypersonic weapon may include any hypersonic weapon including hypersonic warheads.

The system will utilize stationary or moving defensive fields placed in the path of an incoming hypersonic weapon. The defensive formation may be composed of three-dimensional patterns of reactive globule spheres, which contain destructive internal contents. The hypersonic weapon may be an aircraft, missile or warhead. The missile's warhead will facilitate its own neutralization by acting as a starter neutron in a U-235 fission-like chain-reaction with the globule spheres.

This proposed hypersonic missile defense system utilizes stationary or moving defensive fields placed in the path of an incoming hypersonic missile. The fields will be composed of reactive globule spheres arranged in three-dimensional cube or sphere patterns. The hypersonic missiles warhead's properties of speed and density are designed to be harnessed to serve as a starter neutron in a U-235 fission-like chain reaction with the globule spheres that form the field. The globule spheres may feature a pressurized internal cavity that contains smaller metal fission balls, a proximity fuse, a charged capacitor, and meta-materials. After impact with the warhead the globules will release a defensive, anti-aircraft flak-like cloud. The meta-materials in the cloud will induce a variety of destructive effects on the hypersonic weapon including: 1. Rapid change in aerodynamic shape to induce tumbling through metal material attachment. 2 Increased drag to reduce warhead speed from suffocation of air-breathing scram jet delivery vehicles and/or a cold plasma electrostatic repulsion effect. 3 Cryogenic embrittlement of the warhead s flight surfaces to reduce the impact zone on the intended target. Multiple arrays of fields composed of globules with different configurations can be utilized to create a layered defense. Similarities for this invention exist in patents for meta-materials, proximity fuses, naval nuclear reactors and braking systems for magnetic lift trains.

Related concepts include the "Brilliant Pebbles" satellite defense theory against Intercontinental Ballistic Missiles (ICBMs), swarm technology and the use of a cold plasma effect to create stealth for air frames via the attenuation of radar waves from interactions with ionized air molecules.

Potential commercial uses include defense against drones at commercial airports and decelerator systems for malfunctioning space vehicles/satellites.

Figure 2:
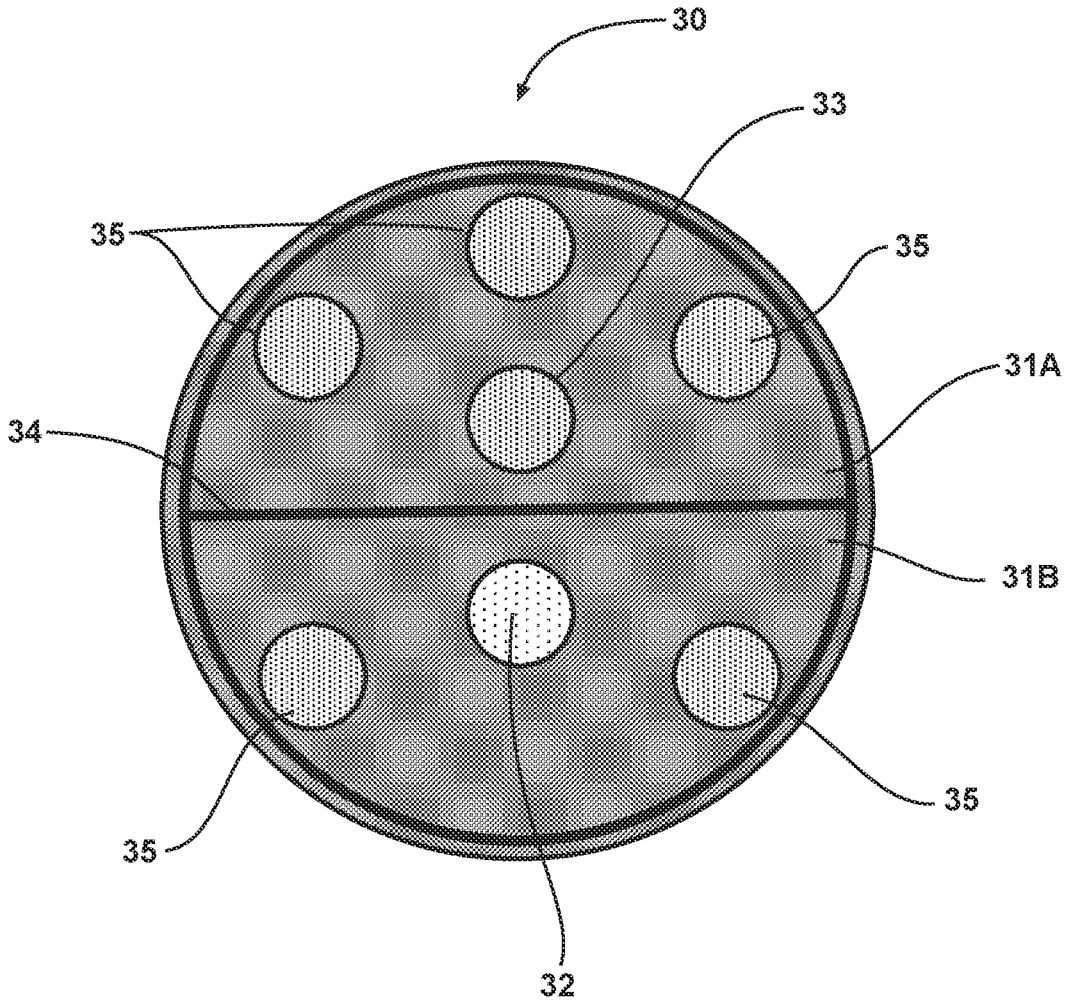
FIG. 2 is an illustration of one embodiment of the present invention's globule sphere.

FIG. 2 illustrates details of the globule spheres (spheres) 30 where they include a first formation material 31A and a second formation material 31B, at least one charged capacitor capsule 32, at least one proximity fuse 33 a membrane 34 separating the first formation material 31A from the second formation material 31B, and fission material 35.

The first formation material 31A and second formation material 31B may be a metal, a polymer or other binary acting material as detailed below.

The proximity fuse preferably includes and piezoelectric pressure sensor, pressure transducer, oscillatory coil, or oscillator detection amplifier, to command a detonator to detonate an explosive charge (not shown). Such combinations are known in the art. The proximity fuses will hasten the chain-reaction by ensuring the explosion of additional peripheral globule balls from the resultant change in air pressure. The proximity fuse will contain a small charge and accelerometer circuitry.

The fission material 35 may preferably be spheres as illustrated in FIG. 1, or any other shape. The fission material may include any combination of tungsten, depleted uranium, or steel. In one embodiment the fission material is spherical tungsten coated with hardened steel.

The plurality of the fission material 35 are designed to split other globule spheres 30 on contact and cause physical damage to the hypersonic weapon. The fission material 35 preferably has a cross section or diameter of about 45 mm to about 48 mm.

The capacitor capsule 32 may include a sealed, ceramic and already be charged when placed into the globule spheres 30. In one embodiment they may be about 25-48 mm in length and about 5 mm to about 10 mm in width.

The internal cavity may be pressurized from about 50 psi (350 kilopascals (kPa)) to about 100 psi (690 kPa).

The membrane 34 separating a first formation material from a second formation material may be composite or metal. In one embodiment the membrane may be made of corrosion resistant, high nickel alloy, or similar metal. The membrane 34 may be about 3 mm to about 5 mm thick depending upon formulation. The membrane 34 is designed to be thick enough to ensure safe storage of components, but thin enough to break after impact.

The claimed a first formation material may include: Cryogenic 1A (Carbon Dioxide Slush Nbr 1)—Liquid CO2; Cryogenic 2A (Carbon Dioxide Slush Nbr 2)—Liquid CO2; Cryogenic 3A (3 stored gases that freeze when mixed)—Trifluoethane Pyrotechnic 1A—Aluminum; Ionic decelerator mix 1A—(Proprietary metal cation powder-[Positive charge]); and combinations thereof.

The second formation material may include Cryogenic 1B (CO2 Dioxide Slush Nbr 1)—Acetone; Cryogenic 2B (Carbon Dioxide Slush Nbr 2)—Isopropyl Alcohol; Cryogenic 3B (3 stored gases that freeze when mixed)—Pentafluoethane; Cryogenic 3C (3 stored gases that freeze when mixed)—Tetrafluoethane Pyrotechnic 1B—Perchlorate Oxidizer; Ionic decelerator mix 1B—(Proprietary nonmetal anion powder [Negative charge]); iodine; appropriate oxides; and combinations thereof.

The formation materials may alternatively be suspended in a nonreactive oil, lubricating oil, vegetable oil, or glycerin, filling the gaps in the capacitor capsule 32

The formation materials are designed to be rapidly released. The fission spheres 35 are designed to strike additional globule spheres in close proximity, thus starting a chain-reaction.

The physical damage would be especially effective of warhead surfaces that become embrittled from a freezing effect.

Figure 3:
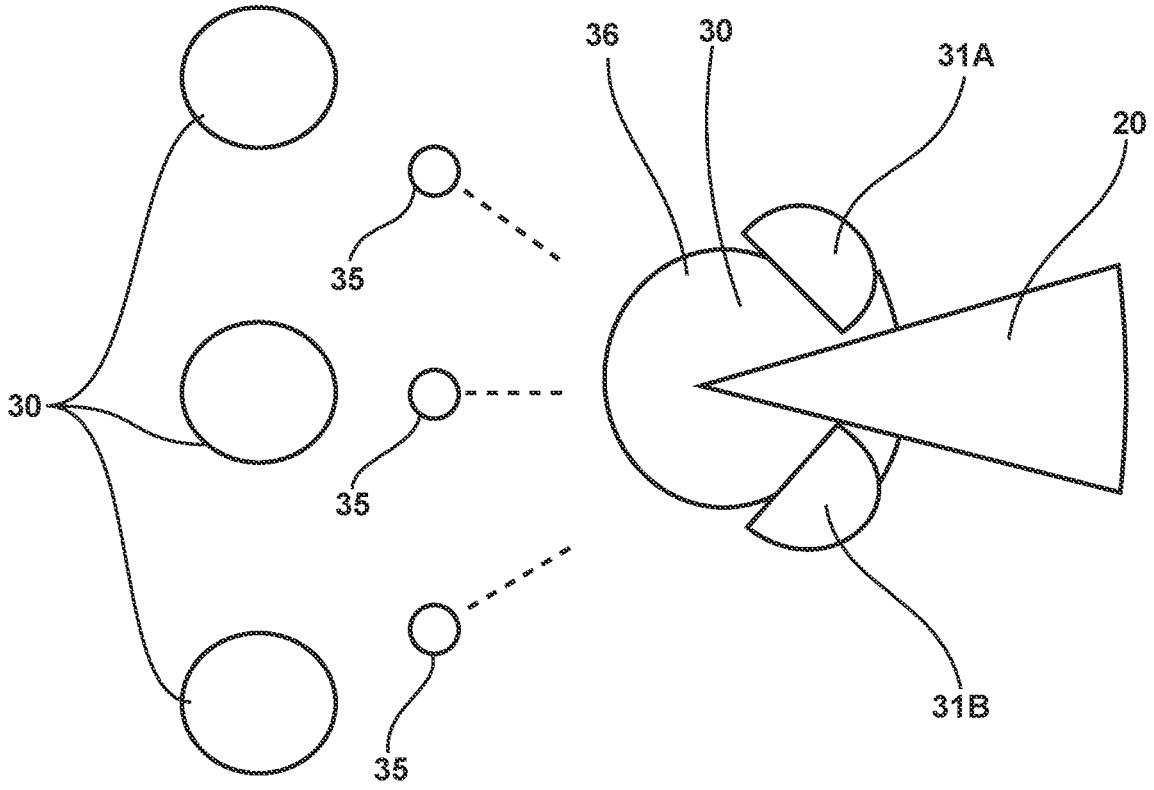
FIG. 3 is an illustration of one embodiment of the present invention where the hypersonic vehicle impacts a globule sphere.

FIG. 3 illustrates that a portion of the globule spheres 30 explode from impact with the hypersonic weapon 20, the internal fission balls 35 spreading into and away from the hypersonic weapon. The first formation material 31A and the second formation material 31B forming a formation material cloud 36 wherein the internal fission balls 35 spreading away from the hypersonic weapon are designed to detonate other spears 30 near the hypersonic weapon 20. The internal fission balls 35 spreading into the hypersonic weapon 20 are designed to damage and degrade the hypersonic weapon 20.

Figure 4:
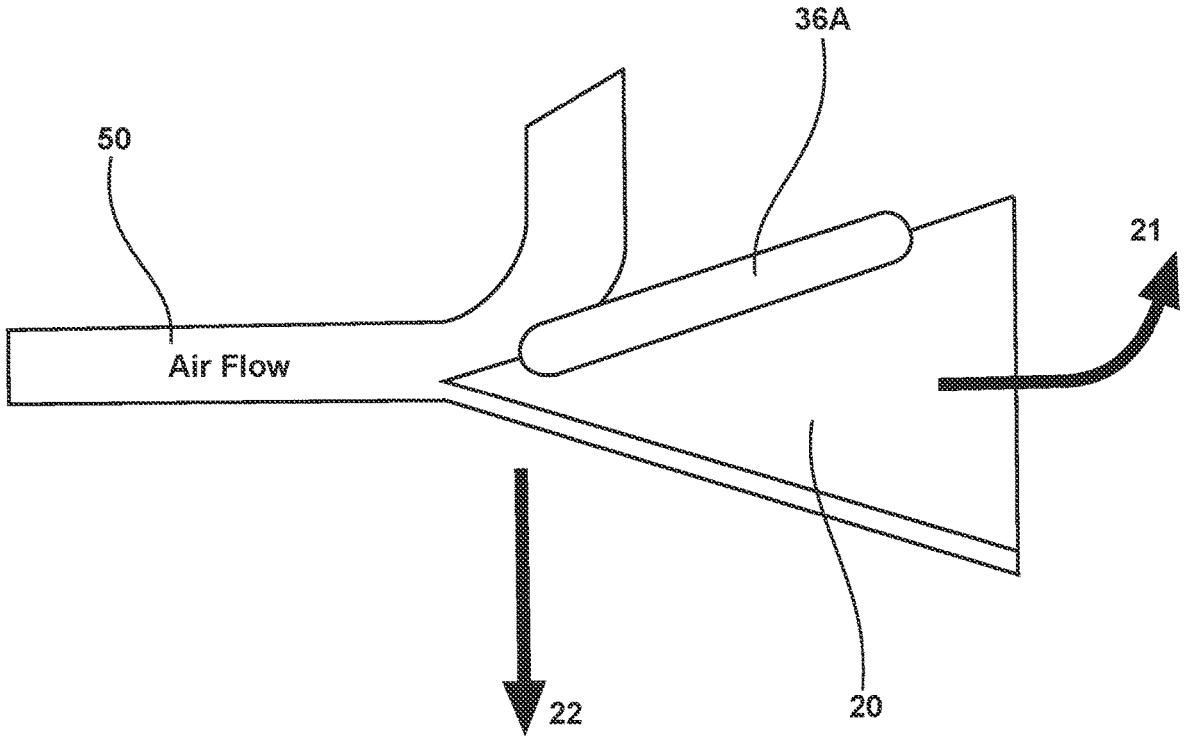
FIG. 4 is an illustration of meta-material adhesion to a hypersonic vehicle or warhead.

As illustrated in FIG. 4, at least a portion of the formation material cloud 36 (FIG. 3) may adhere 36A to the weapon 20, disrupting the weapon 20 aerodynamics, where the disruption is to a weapon yaw 21, a weapon pitch 22 or a combination thereof.

The reaction will create a dense, viscous, anti-aircraft flak-like cloud of formation materials 36A, which will envelope all, or part of the warhead. As the meta-materials become attached to the warhead by adhesion, they will generate a variety of destructive effects.

The primary desired effect would be a rapid change in the aerodynamics of the warhead from the attached metal-material. An unanticipated alteration of shape and weight of an airframe at hypersonic speed will likely generate an unrecoverable change in pitch and/or yaw and induce tumbling of the warhead.

Alternate destructive effects can be a reduction of kinetic energy of the warhead by decreasing its velocity and/or mass. In one embodiment the first formation material and or the second formation material can suffocate scram jet air-breathing components used by delivery vehicles.

Figure 5A:
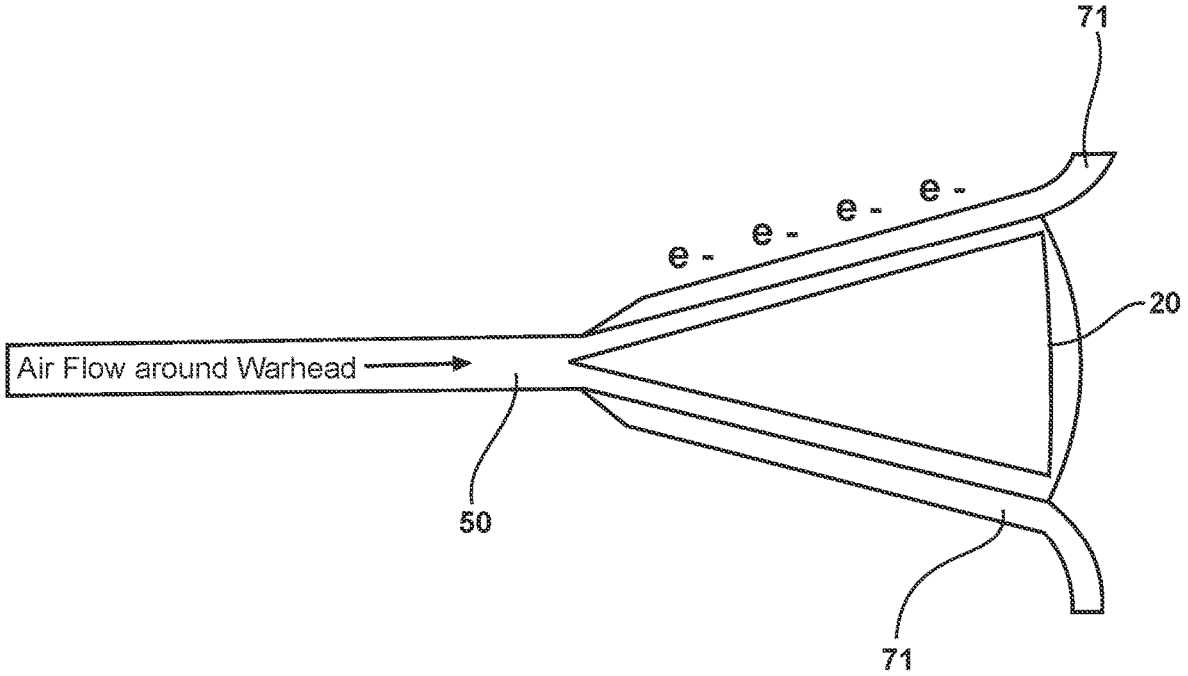
FIG. 5A is an illustration of electrostatic deceleration of a hypersonic vehicle or warhead.
Figure 5B:
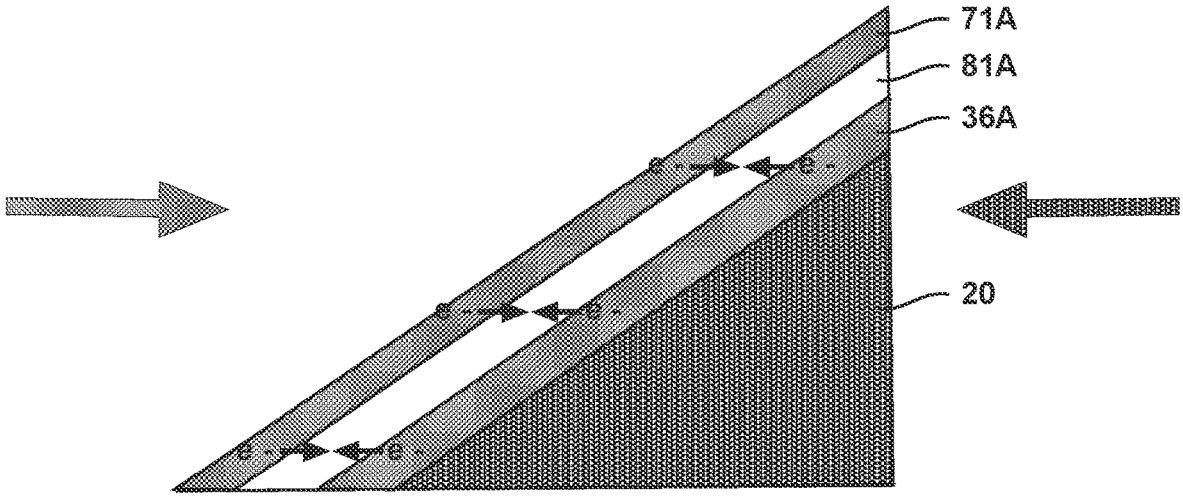
FIG. 5B is a second close up illustration of electrostatic deceleration of a hypersonic vehicle or warhead.

As illustrated in FIG. 5A and FIG. 5B, deceleration can also be brought about by repulsive interaction of the first formation material and second formation material cloud 36A with cold charged plasma 71, which forms just off the airflow 50 around a hypersonic weapon 20. The hypersonic weapon 20 will experience a natural accumulation of an electrostatic charge in flight from ionization of air molecules. The charged capacitor capsule 32 of the globule 30 may be used to impart a like (negative) electrical field to the formation materials 36A on the hypersonic weapon 20 as illustrated in FIG. 5B. The repulsive interaction on the surface of the weapon 20 between formation materials 36A on the hypersonic weapon 20 and the charged cold plasma 71A may result in electrostatic deceleration, decreasing the range and effectiveness of the hypersonic weapon.

An example of the hypersonic weapon disabling is illustrated in FIG. 5A, where the hypersonic weapon 20 will experience a natural accumulation of an electrostatic charge 71E within the plasma 71 in flight from the ionization of air molecules. A charged capacitor 32 can be inserted inside the globules to impart a like electrical field to the formation cloud 36A after impact. The repulsive interaction on the surface of the warhead will result in electrostatic deceleration and weapon delivery failure.

The formation cloud 36A on the hypersonic weapon 20 may have other impacts upon the weapon 20. Mass reduction can be generated through a freezing process similar to material contact with liquid nitrogen. Binary ingredients that freeze after mixing and exposure to air can be kept separated inside the globule by a membrane. When the metal-materials freeze on the surface of the warhead they can decrease the ductility of the warhead by preventing slippage of metallurgic plates. As the warhead maneuvers through waypoints wind shear may tear-off pieces of flight surfaces. Finally, cryogenic embrittlement may make the warhead too fragile to be effective on impact.

The defensive fields of globule spheres 30 may provide for passive or active defense. The defensive fields can be deployed passively in stationary fields in orbit, or neutrally buoyant inside of a dirigible. The defensive fields can be deployed actively through intercepts from kill-vehicle satellites, surface-to-air/air-to-air missiles, multi-cell ground cannon batteries or the like. A hybrid passive/active technique can be utilized by networked carrier drones that swarm on command to form globule defensive fields on command. They can also adjust the field's position based on feed from early warning systems. Multiple arrays of defensive fields composed of globules with different configurations may be utilized used to achieve a layered defense.

While this disclosed design is susceptible of being embodied in many different forms, there is shown in the drawings and will herein be described in detail specific embodiments, with the understanding that the present disclosure is to be considered as an example of the principles of the disclosed design and not intended to limit the disclosed design to the specific embodiments shown and described. In the description below, like reference numerals may be used to describe the same, similar or corresponding parts in the several views of the drawings.

It should be appreciated that the devices, systems and methods described above are set forth by way of example and not of limitation. Absent an explicit indication to the contrary, the disclosed steps may be modified, supplemented, omitted, and/or re-ordered without departing from the scope of this disclosure. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A hypersonic missile defense system for protecting a target from a hypersonic weapon, wherein the system includes:

a plurality of globule spheres in a defensive formation between the target and the hypersonic weapon; and wherein the globule spheres each include:

a proximity fuse;

a plurality of fission spheres;

a capacitor capsule; and a membrane separating a first formation material from a second formation material within the globule sphere.

2. The hypersonic missile defense system of claim 1 wherein the fission spheres include tungsten, depleted uranium, steel or combinations thereof.

3. The hypersonic missile defense system of claim 2 wherein the fission spheres comprise spherical tungsten coated with hardened steel.

4. The hypersonic missile defense system of claim 1 wherein the capacitor capsule includes a charged and sealed ceramic.

5. The hypersonic missile defense system of claim 1 wherein the membrane comprises a metal.

6. The hypersonic missile defense system of claim 5 wherein the metal is a corrosion resistant, high nickel alloy.

7. The hypersonic missile defense system of claim 1 wherein the membrane is 3 mm to 5 mm in thickness.

8. A process for using the hypersonic missile defense system of claim 1 wherein the globule spheres are launched and placed in the path of the hypersonic weapon and create a defensive formation of globule spheres.

9. The process of claim 8 wherein the globule spheres detect their proximity to the hypersonic weapon with the proximity fuse and detonate, creating a field of globules that degrade the hypersonic weapon aerodynamics and impede its arrival at the target.

* * * * *